US012312875B2

(12) United States Patent
Murtaza et al.

(10) Patent No.: US 12,312,875 B2
(45) Date of Patent: May 27, 2025

(54) MOVEMENT JOINT FOR TUBING STRING

(71) Applicant: Saudi Arabian Oil Company, Dhahran (SA)

(72) Inventors: Shoaib Murtaza, Abqaiq (SA); Khalaf A. Alotaibi, Abqaiq (SA); Zaid A. Binhaji, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/462,194

(22) Filed: Sep. 6, 2023

(65) Prior Publication Data

US 2025/0075566 A1 Mar. 6, 2025

(51) Int. Cl.
*E21B 17/06* (2006.01)

(52) U.S. Cl.
CPC ..... *E21B 17/06* (2013.01)

(58) Field of Classification Search
CPC ..... E21B 17/06
See application file for complete search history.

(56) References Cited

U.S. PATENT DOCUMENTS

| | | | | |
|---|---|---|---|---|
| 11,149,523 | B2 * | 10/2021 | Saraya | E21B 33/14 |
| 2008/0099210 | A1 * | 5/2008 | Gazewood | E21B 17/06 166/242.6 |
| 2013/0153207 | A1 * | 6/2013 | Lauderdale | E21B 17/07 166/123 |
| 2016/0153248 | A1 * | 6/2016 | Richards | E21B 17/06 166/335 |
| 2021/0047894 | A1 * | 2/2021 | Robertson | E21B 4/12 |

* cited by examiner

*Primary Examiner* — Brad Harcourt
(74) *Attorney, Agent, or Firm* — Fish & Richardson P.C.

(57) ABSTRACT

A movement joint includes a first tubular body, a second tubular body, a releasable fastener, and an axial lock. The first tubular body is connected to a tubing disposed in a wellbore, and includes an inner surface defining a first central bore. The second tubular body is disposed within the first central bore, and includes an inner surface defining a second central bore in fluid communication with the first central bore. The releasable fastener is positioned between the inner surface of the first tubular body and the outer surface of the second tubular body, axially connects the second tubular body to the first tubular body, and has a maximum tension threshold that is less than a tensile break strength of the tubing. The axial lock selectively engages the first tubular body and the second tubular body after a release of the releasable fastener.

14 Claims, 3 Drawing Sheets

MOVEMENT JOINT FOR TUBING STRING

TECHNICAL FIELD

This disclosure relates to movement joints for tubing strings, such as downhole movement joints in a wellbore.

BACKGROUND

Downhole tubing in wellbores, such as drill strings, production tubing, or other well tubing, often experiences scale accumulation, corrosion, or normal degradation of seals or tools along the tubing that prevents the tubing from freely moving within the seal bore or tools. When a tubing string is stuck inside a seal bore of a downhole packer or other tool, tubing contraction or tubing retrieval from a wellhead can cause excessive tensile stress and lead to parted tubing compromising well integrity.

SUMMARY

This disclosure describes movement joints for wellbore tubing strings.

In some aspects, a downhole movement joint includes a first tubular body, a second tubular body, a releasable fastener connected to the first tubular body and the second tubular body, and an axial lock connected to the first tubular body, the second tubular body, or both. The first tubular body connects to a tubing disposed in a wellbore, and includes a first inner surface defining a first central bore aligned on a longitudinal axis, and a first outer surface. The second tubular body is disposed at least partially within the first central bore of the first tubular body and is aligned on the longitudinal axis. The second tubular body includes a second inner surface defining a second central bore in fluid communication with the first central bore, and a second outer surface. The releasable fastener is positioned between the first inner surface of the first tubular body and the second outer surface of the second tubular body, and the releasable fastener axially connects the second tubular body to the first tubular body. The releasable fastener has a maximum tension threshold that is less than a tensile break strength of the tubing. The axial lock selectively engages the first tubular body and the second tubular body after a release of the releasable fastener.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
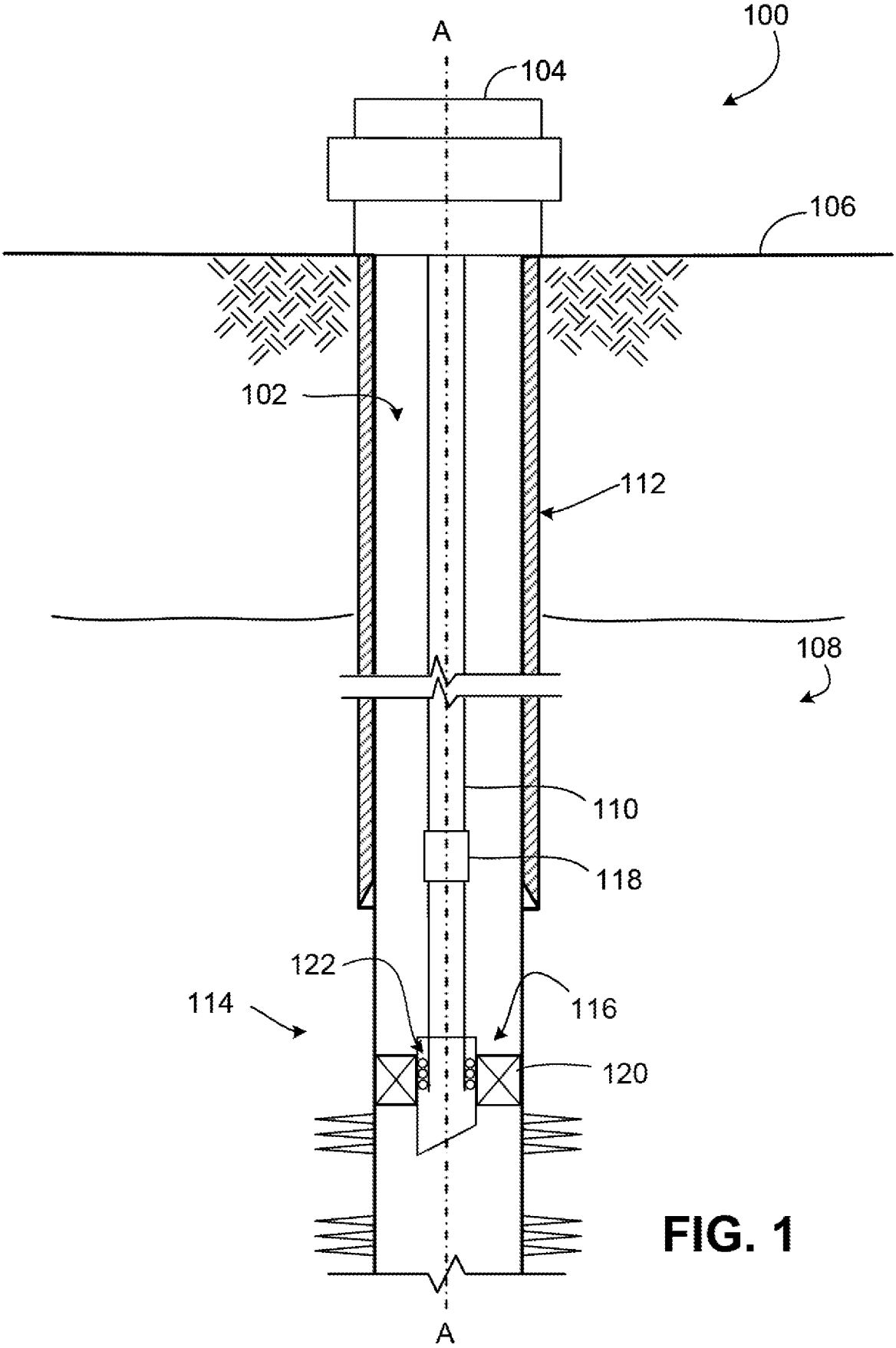
FIG. 1 is a schematic, partial cross-sectional side view of an example well system including an example movement joint on a tubing string.

This disclosure describes movement joints for wellbore tubing strings, such as one or more movement joints disposed along a tubing string in a wellbore. A movement joint of the present disclosure is a type of tubing joint that provides limited movement capability of a tubing string under tension, such as a stuck tubing string in a wellbore, such as a stuck tubing in a seal bore of a packer tool. The movement joint selectively connects two portions of the tubing string together, and allows for relative movement (for example, less than 10 feet, such as between 2 and 3 feet) between the two portions of tubing, for example, when the tubing string experiences tensile forces greater than a defined tensile force threshold. The tensile force threshold is less than a tensile strength of the tubing string material, but greater than expected tensile forces on the tubing string such as the forces experienced during overpull operations of a tubing string. For example, a 4½" J-55 tubing has a joint strength of 160,000 pound-force (lbf), and for a tubing weight for 6,000 feet (ft) of tubing string, the available overpull is 100,000 lbf. A movement joint described herein can be set to support about 80% of this lbf value (around 80,000 lbf). For example, a shear screw or other releasable fastener within the movement joint can be rated to support a lbf that is less than the joint strength of the tubing (such as 160,000 lbf) and greater than or less than the available overpull (such as 100,000 lbf), such as 80,000 lbf.

In some implementations, the movement joint includes a first tubular body and a second tubular body that is positioned partially within the first tubular body, such as sleeved within the first tubular body. In some examples, the first tubular body, the second tubular body, or both, can form a portion of a tubing or couple to a tubing. A releasable fastener (for example, shear screw(s), shear pin(s), or other frangible fastener) supports the second tubular body relative to the first tubular body in a first axial position within a tensile force threshold. If the first movement joint and second movement joint experience tensile forces greater than the tensile force threshold, the releasable fastener breaks, and the second tubular body is free to translate relative to the first tubular body toward a second axial position. The movement joint can also include an axial lock, such as a shoulder on the first tubular body that engages a surface of the second tubular body, to support the second tubular body in the second axial position relative to the first tubular body. The axial lock prevents the second tubular body from entirely disconnecting from the first tubular body.

In some implementations, a tubing string is stung into a packer assembly installed downhole in a wellbore near a reservoir formation, and the tubing string is used to produce hydrocarbons from the reservoir to a wellhead at a surface of the wellbore. The downhole end of the tubing string includes a seal, which is stung into a seal bore of the packer assembly, thus providing a pressure tight seal assembly. At the same time, the downhole end of the tubing string can longitudinally slide within the seal bore of the packer assembly, for example, due to normal expansion and contraction of the tubing string relative to a static positioning of the packer assembly against the reservoir formation. The tubing string may become stuck in the wellbore due to corrosion, scale accumulation, material buildup, wellbore degradation, or a number of other factors at the packer assembly or elsewhere along the tubing string or wellbore.

A stuck tubing string may experience tensile forces that are greater than tensile forces experienced during normal operation of the tubing string, such as when the stuck tubing string is overpulled in an attempt to un-stick the tubing from the packer assembly, when a low temperature fluid flows through the tubing string and the tubing string undergoes material contraction, or other situations where the tubing may experience tensile forces. A movement joint installed along the tubing string can provide limited movement capability to a stuck tubing string, for example, to provide redundancy in allowing longitudinal movement of the tubing string, to avoid or reduce the risk of parted tubing, or both. The movement joint can also accommodate a limited tubing elongation, for example, due to a heating effect from produced fluid from a subsurface formation. Such elongation accommodation may avoid tubing distortion and cork screwing of the tubing due to a stuck seal assembly inside the packer assembly.

FIG. 1 is a schematic, partial cross-sectional side view of an example well system 100 that includes a substantially cylindrical wellbore 102 extending from a well head 104 at a surface 106 downward into the Earth into one or more subterranean zones of interest 108 (one shown). The example well system 100 includes a vertical well, with the wellbore 102 extending substantially vertically from the surface 106 to the subterranean zone 108. The concepts herein, however, are applicable to many other different configurations of wells, including horizontal, slanted, or otherwise deviated wells. A well string 110 is shown as having been lowered from the surface 106 into the wellbore 102. The well string 110 is disposed within the wellbore 102, and is substantially cylindrical about central axis A-A. In certain instances, after some or all of the wellbore 102 is drilled, a portion of the wellbore 102 is lined with lengths of tubing, called casing 112. The wellbore 102 can be drilled in stages, and the casing 112 may be installed between stages. The casing 112 can include a series of jointed lengths of tubing coupled together end-to-end or a continuous (for example, not jointed) coiled tubing. The casing 112 forms the cased section of the wellbore 102. In some examples, the well system 100 excludes casings, such as casing 112, and the wellbore 102 is at least partially or entirely open bore. The section(s) of the wellbore 102 exposed to the adjacent formation (for example, without casing or other permanent completion) form the open hole section 114 of the wellbore 102.

In the example well system 100 of FIG. 1, the well string 110 is a tubing string that supports a well tool 116 at a downhole end of the tubing string 110. In the example well system 100 of FIG. 1, the well tool 116 includes a packer assembly with a packer 120 positioned downhole in the wellbore 102, and the tubing string 110 is stung into the packer 120. In the example well system 100, the well tool 116 is a packer assembly with the packer elements 120 that seal against a wall of the wellbore 102. The tubing string 110 includes a seal assembly 122 at the lower, downhole end of the tubing string 110. The downhole end of the tubing string 110 is stung into a packer bore of the packer assembly 116. The seal assembly 122 forms a pressure tight seal with the packer bore, and at the same time the end of the tubing string 110 is free to slide up and down within the packer assembly 120 based on contraction or elongation of the tubing string 110. However, the well tool 116 can vary, and can include additional or different components based on the type of well tool that is disposed on the tubing string 110. The tubing string 110 also includes a movement joint 118 disposed along the tubing string 110, for example, near the well tool 116. For example, the movement joint 118 can be positioned uphole of the well tool 116, such as within one or two joint(s) of tubing string tubing sections from the well tool 116. While the example well system 100 includes a single movement joint 118 along the tubing string 110, the example well system 100 can include additional movement joints along the same tubing string 110 at various downhole positions along the tubing string 110. The movement joint 118 operatively connects the uphole portion of the tubing string 110 that is uphole of the movement joint 118 to the downhole portion of the tubing string 110 that is downhole of the movement joint 118, and allows for limited movement between the uphole portion and downhole portion of the tubing string 110, for example, when the tubing string 110 is experiencing tensile forces at the movement joint that are greater than a threshold tensile force along axis A-A. The movement joint 118 can also allow movement of the tubing string 110 in the opposite direction, such as under compressive force due to the tubing string 110 undergoing elongation.

The movement joint 118 of the example well system 100 of FIG. 1 is shown as positioned close to the well tool 116 and associated packer assembly 120, such as at or within one or two joint(s) of tubing string. However, the location of the movement joint 118 on the tubing string 110 can vary. For example, the movement joint 118 can be at any intermediate location on the tubing string 110 between an uphole end and a downhole end of the tubing string 110. In some instances, one or more movement joints are positioned just uphole of well tool locations or near to the downhole end of the tubing string 110, for example, to minimize the axial load of the tubing string 110 on the movement joint(s) and to avoid undue tensile stress on the movement joint(s), such as from supporting all or a portion of the weight of the tubing string 110.

In the example well system 100 of FIG. 1, the tubing string 110 is made up of production tubing, and can take the form of a production well string. Though the example well system 100 of FIG. 1 shows one movement joint 118 along the tubing string 110, the number of movement joints or well tools or both on the tubing string 110 can vary. For example, the well system 100 can include additional well tools uphole of or downhole of the well tool 116 along the tubing string 110. The movement joint 118 is rugged enough to withstand the harsh wellbore environment and to be included on an actively producing production string (or other type of tubing string).

Figure 2:
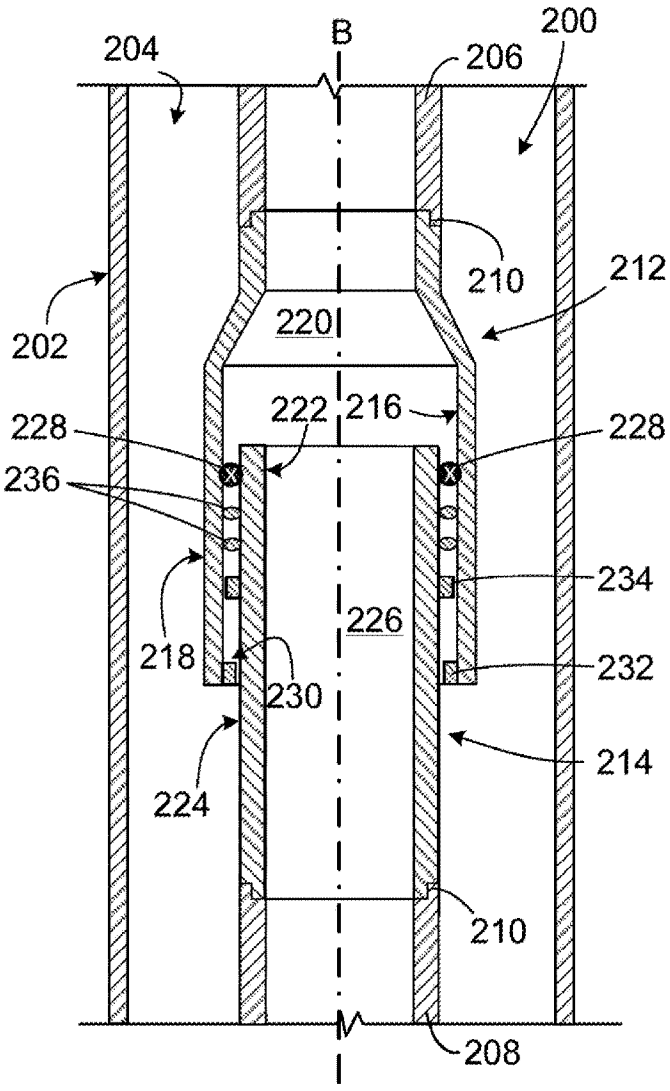
FIG. 2 is a schematic, partial cross-sectional side view of an example movement joint in a first position that can be used in the tubing string of the example well system of FIG. 1.

FIG. 2 is a schematic, partial cross-sectional side view of an example movement joint 200 disposed on a tubing string and within a casing 202 of a wellbore 204. The example movement joint 200 is in line with and coupled to a well tubing, specifically, an adjacent uphole tubing 206 and an adjacent downhole tubing 208. The example movement joint 200 couples to the adjacent uphole tubing 206 and adjacent downhole tubing 208 with tubing connections 210, which can include a threaded pin and box connection or other tubing coupling type, or the tubing sections can be integrally formed. The example movement joint 200 can be used in the example well system 100 of FIG. 1, such as the movement joint 118 carried on the tubing string 110 and positioned within the wellbore 102 of FIG. 1.

The example movement joint 200 includes a first tubular body 212 connected to the uphole tubing 206, and a second tubular body 214 connected to the downhole tubing 208. The first tubular body 212 includes a first inner surface 216 defining a first central bore 220 of the first tubular body 212, and a first outer surface 218. The second tubular body 214 includes a second inner surface 222 defining a second central bore 226 in fluid communication with the first central bore 220, and a second outer surface 224. The first tubular body 212, second tubular body 214, or both, are substantially cylindrical in shape and aligned along central longitudinal axis B-B, where the first tubular body 212 is larger in diameter than the second tubular body 214 such that the second tubular body 214 can reside at least partially within the first tubular body 212, with the first inner surface 216 being radially adjacent to the second outer surface 224. The first inner surface 216 has an inner diameter that is greater than an outer diameter of the second outer surface 224 of the second tubular body 214. In some instances, the first inner surface 216 and the second outer surface 224 are separated by an annular gap forming an annulus between the first tubular body 212 and the second tubular body 214.

The example movement joint 200 can include a full-bore pass through along an entire longitudinal length of the example movement joint 200 (for example, along B-B). The full-bore pass through allows for fluid communication across the first tubular body 212 and the second tubular body 214, for example, from the downhole tubing 208 to the uphole tubing 206 or from the uphole tubing 206 to the downhole tubing 208. The full-bore pass through also allows for fluid, tools (for example, dropped balls or tags), or other components to pass through the example movement joint 200.

The example movement joint 200 includes a releasable fastener 228 that connects the first tubular body 212 and the second tubular body 214 together. The releasable fastener 228 is positioned in the annulus between the first inner surface 216 of the first tubular body 212 and the second outer surface 224 of the second tubular body 214, and supports the second tubular body 214 in a first axial position relative to the first tubular body 212 along longitudinal axis B-B. The releasable fastener 228 acts to axially connect the first tubular body 212 and second tubular body 214 together, for example, to longitudinally support the second tubular body 214 on the first tubular body 212 and transmit forces, rotation, movement, or a combination of these between the first tubular body 212 and the second tubular body 214. The releasable fastener 228 is releasable, in that the releasable fastener 228 can disconnect the first tubular body 212 and the second tubular body 214 in response to experiencing a tensile force greater than a maximum tension threshold. The maximum tension threshold is less than a tensile break strength of the first tubular body 212, the second tubular body 214, and other portions of the tubing string, but is greater than tensile forces applied to the tubing string during normal wellbore operations or overpull operations. For example, the maximum tension threshold can include a tensile force value that is 20% less than the tensile break strength of the tubing string, 10% less than the tensile break strength of the tubing string, or an intermediate value between 10% less and 20% less than the tensile break strength of the tubing string.

In operation, the releasable fastener 228 maintains connection between the first tubular body 212 and the second tubular body 214 when experiencing tensile forces that are less than the maximum tension threshold, and the releasable fastener 228 releases the connection between the first and second tubular bodies under tensile forces that are greater than the maximum tension threshold. Release of the releasable fastener 228 allows for axial translation of the second tubular body 214 along axis B-B relative to the first tubular body 212.

The releasable fastener 228 can take a variety of forms. In some implementations, the releasable fastener 228 is a frangible fastener that breaks in response to sufficient applied forces. For example, the frangible fastener can include one or more shear pins, one or more shear screws, or another type of frangible fastener that shear under sufficient force. For example, the releasable fastener 228 can include multiple shear screws disposed circumferentially around the first inner surface 216 and the second outer surface 224. The number of shear screws (or shear pins) connecting first tubular body 212 and the second tubular body 214 can vary, for example, based on a desired maximum tension threshold. For example, the break strength of the releasable fastener 228 can be adjusted by increasing or decreasing the number of shear screws or shear pins. In some instances, the releasable fastener 228 includes a ring of shear pins or shear screws positioned around an uphole longitudinal end of the second tubular body 214 on the second outer surface 224, which support the second tubular body 214 in the first axial position relative to the first tubular body 212.

The example movement joint 200 is shown in FIG. 2 in the first axial position, where the releasable fastener 228 supports the second tubular body 214 relative to the first tubular body 212 in the first axial position with respect to axis B-B. After release of the releasable fastener 228, the second tubular body 214 is free to translate from the first position (shown in FIG. 2) to a different axial position. In some instances, tensile forces act to pull the first tubular body 212 and second tubular body 214 away from each other, for example, such that the second tubular body 214 moves in a downhole direction relative to the first tubular body 212. In some implementations, the example movement joint 200 includes an axial lock 230 connected to the first tubular body 212, the second tubular body 214, or both, to maintain axial connection between the first tubular body 212 and second tubular body 214 after release of the releasable fastener 228. For example, the axial lock 230 provides a maximum relative translation (for example, less than 10 feet) between the first tubular body 212 and the second tubular body 214 after release of the releasable fastener 228. The axial lock 230 prevents the second tubular body 214 from entirely disconnecting from the first tubular body 212, such that the first tubular body 212 and the second tubular body 214 cannot be disengaged completely from each other due to relative axial translation and axial forces.

Figure 3:
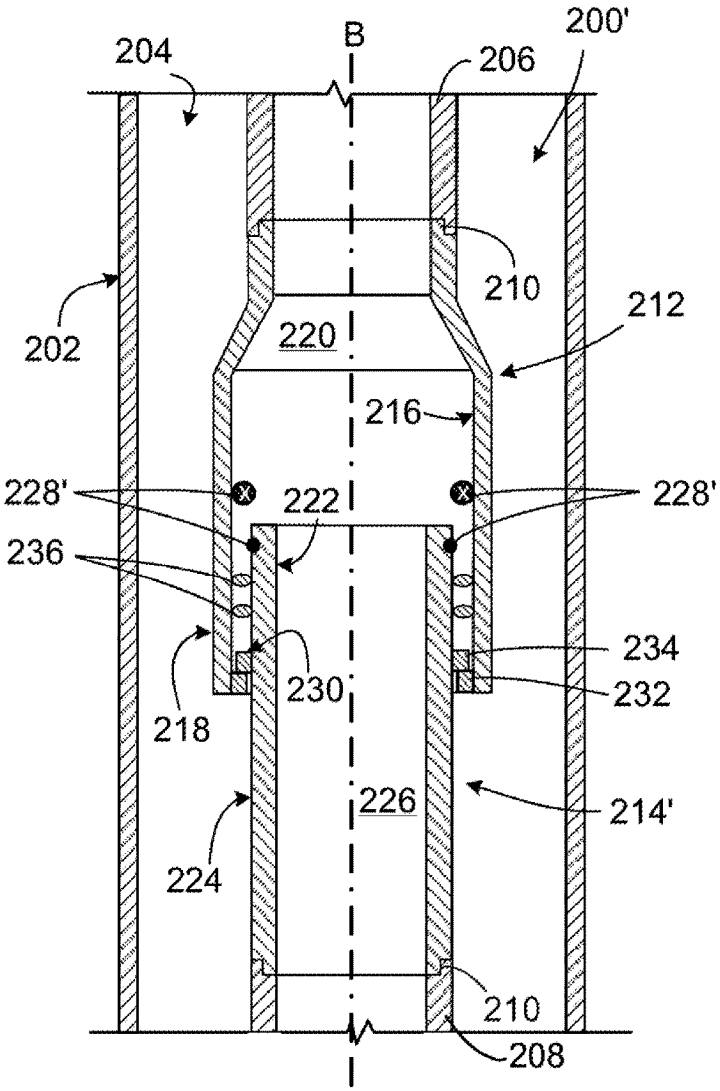
FIG. 3 is a schematic, partial cross-sectional side view of the example movement joint of FIG. 2 in a second position.

FIG. 3 is a schematic, partial cross-sectional side view of an example movement joint 200', which is the same as the example movement joint 200 of FIG. 2, except that the example movement joint 200' of FIG. 3 shows the second tubular body 214' in a second position relative to the first tubular body 212 after the releasable fastener 228' is released. In the example movement joint 200, 200' of FIGS. 2 and 3, the axial lock 230 is formed by a first annular shoulder 232 of the first tubular body 212 and a second annular shoulder 234 of the second tubular portion. The first annular shoulder 232 includes a first shoulder surface that extends radially inward from the first inner surface 216 of the first tubular body 212 and toward the second outer surface 224 of the second tubular body 214. The second annular shoulder 234 includes a second shoulder surface 234 that extends radially outward from the second outer surface 224 of the second tubular body 214 and toward the first inner surface 216 of the first tubular body 212. The first shoulder surface and the second shoulder surface are spaced apart in the first axial position of the second tubular body 214, as depicted in FIG. 2, such as when the releasable fastener 228 is intact. Upon release of the releasable fastener 228, the second tubular body 214 axially translates relative to the first tubular body 212 until the first shoulder surface and the second shoulder surface engage each other, as depicted in FIG. 3. The example movement joint 200' is shown in FIG. 3 in the second axial position, for example, with the first annular shoulder 232 engaged with the second annular shoulder 234, to prevent further axial movement of the second tubular body 214 away from the first tubular body 212.

The maximum relative translation of the second tubular body 214' and the first tubular body 212 can vary, for example, based on the scale and size of the first and second tubular bodies, and the distance between the annular shoulders 232, 234 when the second tubular body 214, 214' is in the first axial position. In some instances, the maximum relative translation is less than or equal to 10 feet. In some examples, the maximum relative translation is between 2 feet and 3 feet. However, this maximum relative translation can vary to be larger or smaller.

In some implementations, the example movement joint 200, 200' includes a seal assembly 236 positioned in the annulus between the first inner surface 216 and the second outer surface 224. The seal assembly 236 can fluidly seal the annulus between the first inner surface 216 and the second outer surface 224, for example, with the example movement joint 200, 200' in the first axial position, the second axial position, or an intermediate position between the first axial position and the second axial position. In some implementations, the seal assembly 236 includes one or more ring seals (two shown) engaged with the first inner surface 216 and the second outer surface 224. The seal assembly 236 is positioned axially between the releasable fastener 228 and the axial lock 230, for example, to maintain the annular fluid seal regardless of the relative positioning of the first tubular body 212 and the second tubular body 214. In some examples, the seal assembly 236 maintains pressure integrity of the tubing string across the example movement joint 200, 200' while allowing for sliding movement, for example, to accommodate elongation and contraction of the tubing string during normal well operations.

Although the example movement joint 200 of FIG. 2 is shown as having the first tubular body 212 connected to the uphole tubular body 206 and the second tubular body 214 as connected to the downhole tubular body 208, the first and second tubular bodies can be flipped. For example, the first tubular body 212 can connect to the downhole tubular body 208 and the second tubular body 214 can connect to the uphole tubular body 206, and the releasable fastener 228, axial lock 230, seal assembly 236, or a combination of these, can still function as described herein. In some instances, the orientation of the first tubular body 212 and second tubular body 214 of the example movement joint 200 reduces or prevents debris from entering the annular space between two tubular bodies and fouling the movement joint, for example, as compared to the orientation where the two tubular bodies are longitudinally swapped.

Figure 4:
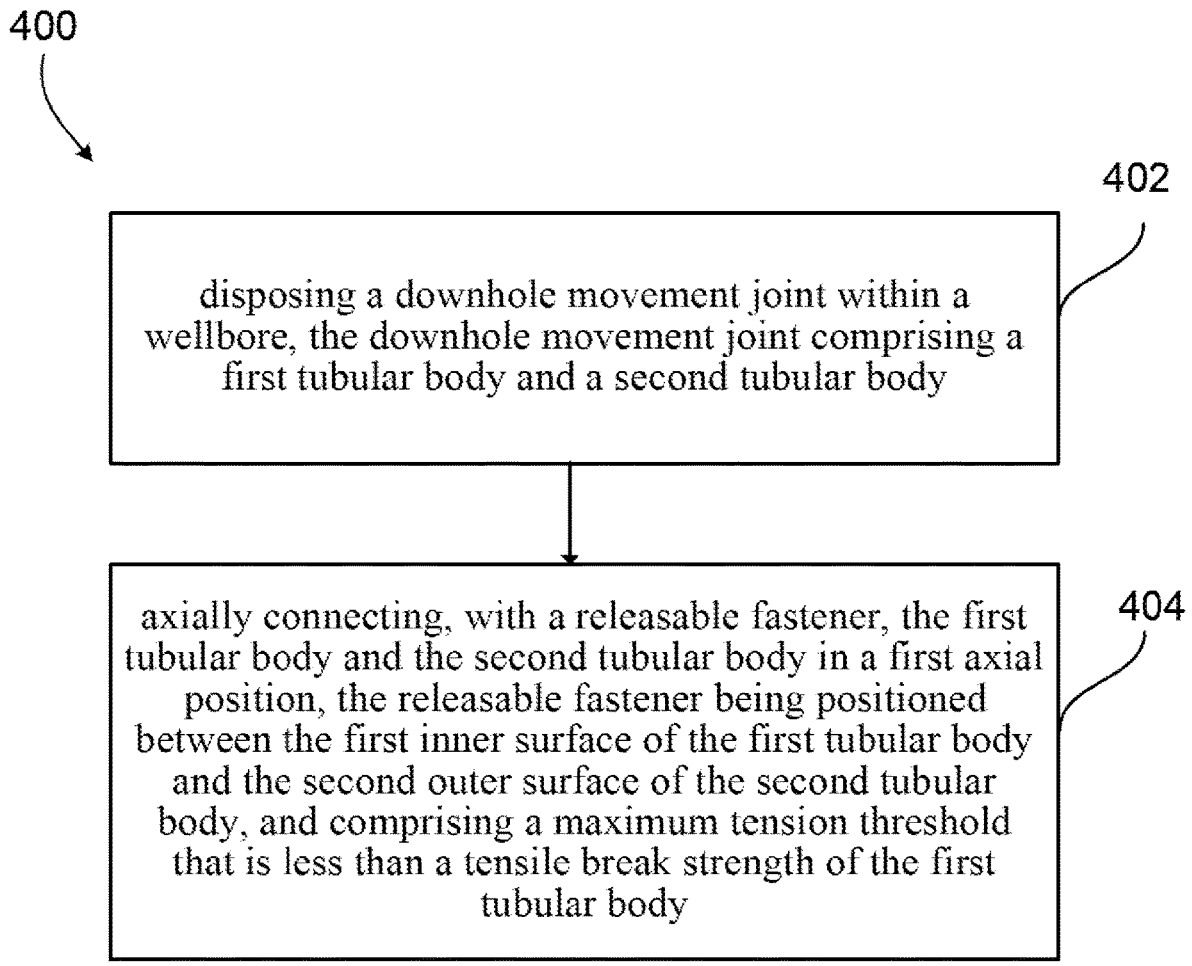
FIG. 4 is a flowchart describing an example method for connecting tubing with a movement joint along a tubing string.

FIG. 4 is a flowchart describing an example method 400 for connecting tubing along a tubing string, for example, performed by the example movement joint 200, 200' of FIGS. 2-3. At 402, a downhole movement joint is disposed within a wellbore. The downhole movement joint includes a first tubular body and a second tubular body. The first tubular body includes a first inner surface defining a first central bore aligned on a longitudinal axis, and a first outer surface. The second tubular body is disposed at least partially within the first central bore of the first tubular body and is aligned on the longitudinal axis, and includes a second inner surface defining a second central bore in fluid communication with the first central bore, and a second outer surface. At 404, a releasable fastener axially connects the first tubular body and the second tubular body in a first axial position. The releasable fastener is positioned between the first inner surface of the first tubular body and the second outer surface of the second tubular body, and includes a maximum tension threshold that is less than a tensile break strength of the tubing string, such as the tensile break strength of the first tubular body, the second tubular body, another tubing component of the tubing string, or a combination of these. In some instances, the example method 400 includes releasing the releasable fastener to axially release the second tubular body from the first tubular body in response to an axial tension on the releasable fastener being greater than the maximum tension threshold. Also in response, the second tubular body translates relative to the first tubular body from the first axial position to a second axial position. In some implementations, the releasable fastener includes a frangible fastener, and releasing the releasable fastener includes shearing the frangible fastener under the axial tension. In some examples, after releasing the releasable fastener, the example method 400 includes axially supporting the second tubular body on the first tubular body in the second axial position with an axial lock. In certain implementations, the example method 400 includes flowing fluid through the second central bore of the second tubular body and the first central bore of the first tubular body, and fluidly sealing an annulus between the first inner surface of the first tubular body and the second outer surface of the second tubular body with a seal assembly. The seal assembly is positioned between the first inner surface and the second outer surface, and can include one or more seals.

While this disclosure contains many specific implementation details, these should not be construed as limitations on the scope of what may be claimed, but rather as descriptions of features specific to particular implementations. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

Thus, particular implementations of the subject matter have been described. Other implementations are within the scope of the following claims. Various modifications may be made without departing from the spirit and scope of the disclosure. In some cases, the actions recited in the claims can be performed in a different order and still achieve desirable results. In addition, the processes depicted in the accompanying figures do not necessarily require the particular order shown, or sequential order, to achieve desirable results.

EXAMPLES

In a first aspect, a downhole movement joint comprises a first tubular body configured to connect to a tubing disposed in a wellbore, the first tubular body comprising a first inner surface defining a first central bore aligned on a longitudinal axis, and a first outer surface; a second tubular body disposed at least partially within the first central bore of the first tubular body and aligned on the longitudinal axis, the second tubular body comprising a second inner surface defining a second central bore in fluid communication with the first central bore, and a second outer surface; a releasable fastener connected to the first tubular body and the second tubular body and positioned between the first inner surface of the first tubular body and the second outer surface of the second tubular body, the releasable fastener configured to axially connect the second tubular body to the first tubular body, the releasable fastener comprising a maximum tension threshold that is less than a tensile break strength of the tubing; and an axial lock connected to at least one of the first tubular body or the second tubular body, the axial lock configured to selectively engage the first tubular body and the second tubular body after a release of the releasable fastener.

In second aspect according to the first aspect, the axial lock comprises: a first annular shoulder of the first tubular body, the first annular shoulder comprising a first shoulder surface extending radially inward from the first inner surface of the first tubular body and toward the second outer surface of the second tubular body, and a second annular shoulder of the second tubular body, the second annular shoulder comprising a second shoulder surface extending radially outward from the second outer surface of the second tubular body and toward the first inner surface of the first tubular body.

In a third aspect according to the first aspect or the second aspect, the releasable fastener comprises a frangible fastener connecting the first tubular body to the second tubular body, the frangible fastener configured to shear under an axial tension greater than the maximum tension threshold.

In a fourth aspect according to the third aspect, the frangible fastener comprises at least one shear screw or at least one shear pin coupled to the first tubular body and releasably connected to the second tubular body to axially support the second tubular body relative to the first tubular body.

In a fifth aspect according to any one of the first aspect to the fourth aspect, the downhole movement joint further comprises a seal assembly between the first inner surface of the first tubular body and the second outer surface of the second tubular body, the seal assembly configured to fluidly seal an annulus between the first inner surface and the second outer surface.

In a sixth aspect according to the fifth aspect, the seal assembly comprises a ring seal engaged with the first inner surface and the second outer surface.

In a seventh aspect according to the fifth aspect or the sixth aspect, the seal assembly is positioned axially between the releasable fastener and the axial lock.

In an eighth aspect according to any one of the first aspect to the seventh aspect, the first tubular body is cylindrical and the second tubular body is cylindrical, wherein the first inner surface comprises a first inner diameter greater than a second outer diameter of the second outer surface.

In a ninth aspect according to any one of the first aspect to the eighth aspect, the first central bore and the second central bore define a full-bore pass through along an entire longitudinal length of the first tubular body and the second tubular body.

In a tenth aspect, a method comprises disposing a downhole movement joint within a wellbore, the downhole movement joint comprising: a first tubular body comprising a first inner surface defining a first central bore aligned on a longitudinal axis, and a first outer surface; and a second tubular body disposed at least partially within the first central bore of the first tubular body and aligned on the longitudinal axis, the second tubular body comprising a second inner surface defining a second central bore in fluid communication with the first central bore, and a second outer surface; and axially connecting, with a releasable fastener, the first tubular body and the second tubular body in a first axial position, the releasable fastener being positioned between the first inner surface of the first tubular body and the second outer surface of the second tubular body, and comprising a maximum tension threshold that is less than a tensile break strength of the first tubular body.

In an eleventh aspect according to the tenth aspect, the method further comprises: in response to an axial tension on the releasable fastener being greater than the maximum tension threshold, releasing the releasable fastener to axially release the second tubular body from the first tubular body, and translating the second tubular body relative to the first tubular body from the first axial position to a second axial position.

In a twelfth aspect according to the tenth aspect or the eleventh aspect, the releasable fastener comprises a frangible fastener, and releasing the releasable fastener comprises shearing the frangible fastener under the axial tension.

In a thirteenth aspect according to any one of the tenth aspect to the twelfth aspect, the method further comprises, after releasing the releasable fastener, axially supporting, with an axial lock, the second tubular body on the first tubular body in the second axial position.

In a fourteenth aspect according to the thirteenth aspect, the axial lock comprises: a first annular shoulder of the first tubular body, the first annular shoulder comprising a first shoulder surface extending radially inward from the first inner surface of the first tubular body and toward the second outer surface of the second tubular body, and a second annular shoulder of the second tubular body, the second annular shoulder comprising a second shoulder surface extending radially outward from the second outer surface of the second tubular body and toward the first inner surface of the first tubular body; and axially supporting the second tubular body on the first tubular body in the second axial position comprises engaging the first shoulder surface of the first tubular body with the second shoulder surface of the second tubular body.

In a fifteenth aspect according to any one of the tenth aspect to the fourteenth aspect, the method further comprises flowing fluid through the second central bore of the second tubular body and the first central bore of the first tubular body.

In a sixteenth aspect according to any one of the tenth aspect to the fifteenth aspect, the method further comprises fluidly sealing, with a seal assembly, an annulus between the first inner surface of the first tubular body and the second outer surface of the second tubular body, the seal assembly being positioned between the first inner surface and the second outer surface.

In a seventeenth aspect, a downhole movement joint comprises a first tubular body comprising a first inner surface defining a first central bore aligned on a longitudinal axis, and a first outer surface; a second tubular body disposed at least partially within the first central bore of the first tubular body and aligned on the longitudinal axis, the second tubular body comprising a second inner surface defining a second central bore in fluid communication with the first central bore, and a second outer surface; and a releasable fastener connected to the first tubular body and the second tubular body and positioned between the first inner surface of the first tubular body and the second outer surface of the second tubular body, the releasable fastener configured to axially connect the second tubular body to the first tubular body in a first axial position, the releasable fastener comprising a maximum tension threshold that is less than a tensile break strength of the first tubular body.

In an eighteenth aspect according to the seventeenth aspect, the downhole movement joint further comprises an axial lock connected to at least one of the first tubular body or the second tubular body, the axial lock configured to selectively engage the first tubular body and the second tubular body in a second axial position after a release of the releasable fastener.

In a nineteenth aspect according to the eighteenth aspect, the axial lock comprises: a first annular shoulder of the first tubular body, the first annular shoulder comprising a first shoulder surface extending radially inward from the first inner surface of the first tubular body and toward the second outer surface of the second tubular body, and a second annular shoulder of the second tubular body, the second annular shoulder comprising a second shoulder surface extending radially outward from the second outer surface of the second tubular body and toward the first inner surface of the first tubular body.

In a twentieth aspect according to any one of the seventeenth aspect to the nineteenth aspect, the releasable fastener comprises at least one shear screw or at least one shear pin coupled to the first tubular body and releasably connected to the second tubular body to axially support the second tubular body relative to the first tubular body in the first axial position.

What is claimed is:

1. A downhole movement joint, comprising:

a first tubular body configured to connect to a tubing disposed in a wellbore, the first tubular body comprising a first inner surface defining a first central bore aligned on a longitudinal axis, and a first outer surface;

a second tubular body disposed at least partially within the first central bore of the first tubular body and aligned on the longitudinal axis, the second tubular body comprising a second inner surface defining a second central bore in fluid communication with the first central bore, and a second outer surface;

a releasable fastener connected to the first tubular body and the second tubular body and positioned between the first inner surface of the first tubular body and the second outer surface of the second tubular body, the releasable fastener configured to axially connect the second tubular body to the first tubular body, the releasable fastener comprising a maximum tension threshold that is less than a tensile break strength of the tubing, and the releasable fastener configured to release in response to a tensile force across the first and second tubular bodies that is greater than the maximum tension threshold;

an axial lock connected to at least one of the first tubular body or the second tubular body, the axial lock configured to selectively engage the first tubular body and the second tubular body after a release of the releasable fastener; and a seal assembly between the first inner surface of the first tubular body and the second outer surface of the second tubular body, the seal assembly positioned axially between the releasable fastener and the axial lock after the release of the releasable fastener, the seal assembly configured to fluidly seal an annulus between the first inner surface and the second outer surface.

2. The downhole movement joint of claim 1, wherein the axial lock comprises:

a first annular shoulder of the first tubular body, the first annular shoulder comprising a first shoulder surface extending radially inward from the first inner surface of the first tubular body and toward the second outer surface of the second tubular body, and a second annular shoulder of the second tubular body, the second annular shoulder comprising a second shoulder surface extending radially outward from the second outer surface of the second tubular body and toward the first inner surface of the first tubular body.

3. The downhole movement joint of claim 1, wherein the releasable fastener comprises a frangible fastener connecting the first tubular body to the second tubular body, the frangible fastener configured to shear under an axial tension greater than the maximum tension threshold.

4. The downhole movement joint of claim 3, wherein the frangible fastener comprises at least one shear screw or at least one shear pin coupled to the first tubular body and releasably connected to the second tubular body to axially support the second tubular body relative to the first tubular body.

5. The downhole movement joint of claim 1, wherein the seal assembly comprises a ring seal engaged with the first inner surface and the second outer surface.

6. The downhole movement joint of claim 1, wherein the first tubular body is cylindrical and the second tubular body is cylindrical, wherein the first inner surface comprises a first inner diameter greater than a second outer diameter of the second outer surface.

7. The downhole movement joint of claim 1, wherein the first central bore and the second central bore define a full-bore pass through along an entire longitudinal length of the first tubular body and the second tubular body.

8. A method, comprising:

disposing a downhole movement joint within a wellbore, the downhole movement joint comprising:

a first tubular body comprising a first inner surface defining a first central bore aligned on a longitudinal axis, and a first outer surface; and a second tubular body disposed at least partially within the first central bore of the first tubular body and aligned on the longitudinal axis, the second tubular body comprising a second inner surface defining a second central bore in fluid communication with the first central bore, and a second outer surface;

axially connecting, with a releasable fastener, the first tubular body and the second tubular body in a first axial position, the releasable fastener being positioned between the first inner surface of the first tubular body and the second outer surface of the second tubular body, and comprising a maximum tension threshold that is less than a tensile break strength of the first tubular body, the releasable fastener configured to release in response to a tensile force across the first and second tubular bodies that is greater than the maximum tension threshold;

in response to an axial tension on the releasable fastener and across the first and second tubular bodies being greater than the maximum tension threshold, releasing the releasable fastener to axially release the second tubular body from the first tubular body;

translating the second tubular body relative to the first tubular body from the first axial position to a second axial position; and after releasing the releasable fastener, axially supporting, with an axial lock, the second tubular body on the first tubular body in the second axial position; and fluid sealing, with a seal assembly, an annulus between the first inner surface of the first tubular body and the second outer surface of the second tubular body, the seal assembly positioned between the first inner surface and the second outer surface, and positioned axially between the releasable fastener and the axial lock after releasing the releasable fastener.

9. The method of claim 8, wherein:

the releasable fastener comprises a frangible fastener, and releasing the releasable fastener comprises shearing the frangible fastener under the axial tension.

10. The method of claim 8, wherein:

the axial lock comprises:

a first annular shoulder of the first tubular body, the first annular shoulder comprising a first shoulder surface extending radially inward from the first inner surface of the first tubular body and toward the second outer surface of the second tubular body, and a second annular shoulder of the second tubular body, the second annular shoulder comprising a second shoulder surface extending radially outward from the second outer surface of the second tubular body and toward the first inner surface of the first tubular body; and axially supporting the second tubular body on the first tubular body in the second axial position comprises engaging the first shoulder surface of the first tubular body with the second shoulder surface of the second tubular body.

11. The method of claim 8, further comprising flowing fluid through the second central bore of the second tubular body and the first central bore of the first tubular body.

12. A downhole movement joint, comprising:

a first tubular body comprising a first inner surface defining a first central bore aligned on a longitudinal axis, and a first outer surface;

a second tubular body disposed at least partially within the first central bore of the first tubular body and aligned on the longitudinal axis, the second tubular body comprising a second inner surface defining a second central bore in fluid communication with the first central bore, and a second outer surface;

a releasable fastener connected to the first tubular body and the second tubular body and positioned between the first inner surface of the first tubular body and the second outer surface of the second tubular body, the releasable fastener configured to axially connect the second tubular body to the first tubular body in a first axial position, the releasable fastener comprising a maximum tension threshold that is less than a tensile break strength of the first tubular body, and the releasable fastener configured to release in response to a tensile force across the first and second tubular bodies that is greater than the maximum tension threshold;

an axial lock connected to at least one of the first tubular body or the second tubular body, the axial lock configured to selectively engage the first tubular body and the second tubular body in a second axial position after a release of the releasable fastener; and a seal assembly between the first inner surface of the first tubular body and the second outer surface of the second tubular body, the seal assembly positioned axially between the releasable fastener and the axial lock after the release of the releasable fastener, the seal assembly configured to fluidly seal an annulus between the first inner surface and the second outer surface.

13. The downhole movement joint of claim 12, wherein the axial lock comprises:

a first annular shoulder of the first tubular body, the first annular shoulder comprising a first shoulder surface extending radially inward from the first inner surface of the first tubular body and toward the second outer surface of the second tubular body, and a second annular shoulder of the second tubular body, the second annular shoulder comprising a second shoulder surface extending radially outward from the second outer surface of the second tubular body and toward the first inner surface of the first tubular body.

14. The downhole movement joint of claim 12, wherein the releasable fastener comprises at least one shear screw or at least one shear pin coupled to the first tubular body and releasably connected to the second tubular body to axially support the second tubular body relative to the first tubular body in the first axial position.

* * * * *